United States Patent [19]

Chen

[11] Patent Number: 4,783,082

[45] Date of Patent: Nov. 8, 1988

[54] COMPETITIVE GAME DEVICE

[75] Inventor: Chung C. Chen, Springfield, Va.

[73] Assignee: Chun Nan (Ignatius) Chen, Taipei, Taiwan

[21] Appl. No.: 119,892

[22] Filed: Nov. 12, 1987

[51] Int. Cl.[4] ..... A63F 7/02

[52] U.S. Cl. ..... 273/357; 273/390; 273/399

[58] Field of Search ..... 273/120 R, 328, 357, 273/399, 412, 390

[56] References Cited

U.S. PATENT DOCUMENTS

| | | | |
|---|---|---|---|
| 3,618,949 | 11/1971 | McLain et al. | 273/110 |
| 3,649,019 | 3/1972 | Barlow | 273/1 GE |
| 3,697,075 | 10/1972 | Nania | 273/110 |
| 3,712,621 | 1/1973 | Ames | 273/120 R |
| 3,880,428 | 4/1975 | McComber | 273/110 |
| 4,033,585 | 7/1977 | Foreman | 273/120 R |
| 4,076,243 | 2/1978 | Davis | 273/110 X |
| 4,153,250 | 5/1979 | Anthony | 273/86 C |
| 4,274,630 | 6/1981 | Kulesza et al. | 273/120 X |

*Primary Examiner*—Anton O. Oechsle

[57] ABSTRACT

A competitive game device having mainly a plurality of balls, two sets of obliquely mounted tubes, at least two slidable blocks slidably mounted on two sets of horizontal guide rails and connected with bellow-shaped tubes so that a player can deflect the balls put into the tubes by an opponent player to a winning basket of the player. Stopper means is also provided on each of the tubes so that the players can deposit some balls at selected tubes and thereafter open the stopper means at a selected time. A pivotably mounted ball collecting means, a pointer, and a scale are also provided.

6 Claims, 2 Drawing Sheets

COMPETITIVE GAME DEVICE

This invention relates to a game device, particularly to a competitive game device wherein a plurality of balls can be used and played by people on opposite sides to determine which side responds more quickly and accurately.

PRIOR ART

The following U.S. Pat. Nos. illustrate various conventional ball game devices: McLain et al. U.S. Pat. No. 3,618,949; Nania U.S. Pat. No. 3,697,075; Ames U.S. Pat. No. 3,712,621; McComber U.S. Pat. No. 3,880,428; Davis U.S. Pat. No. 4,076,243; Anthony U.S. Pat. No. 4,153,250; and Kulesza et al. U.S. Pat. No. 4,274,630.

The primary object of the present invention is to provide a novel ball game device which requires skill and coordination of eye and hand, and strategy of tactics of the players. It is another object of the present invention to provide such a device which is easily and simply manufactured.

These together with other objects and advantages which will become subsequently apparent, resides in the details and operation as more fully hereinafter described and claimed, reference being had to the accompanying drawings, wherein like numerals refer to like parts throughout, and in which:

BRIEF DESCRIPTION OF THE DRAWINGS

FIGS. 5—8 show an embodiment of a means for stopping or depositing balls in the present invention, wherein FIGS. 5 and 7 are cross-sectional views, FIGS. 6 and 8 are elevational views; FIGS. 5 and 6 show the means in open position, and FIGS. 7 and 8 show the means in closed position;

DETAILED DESCRIPTION OF A PREFERRED EMBODIMENT

Figure 1:
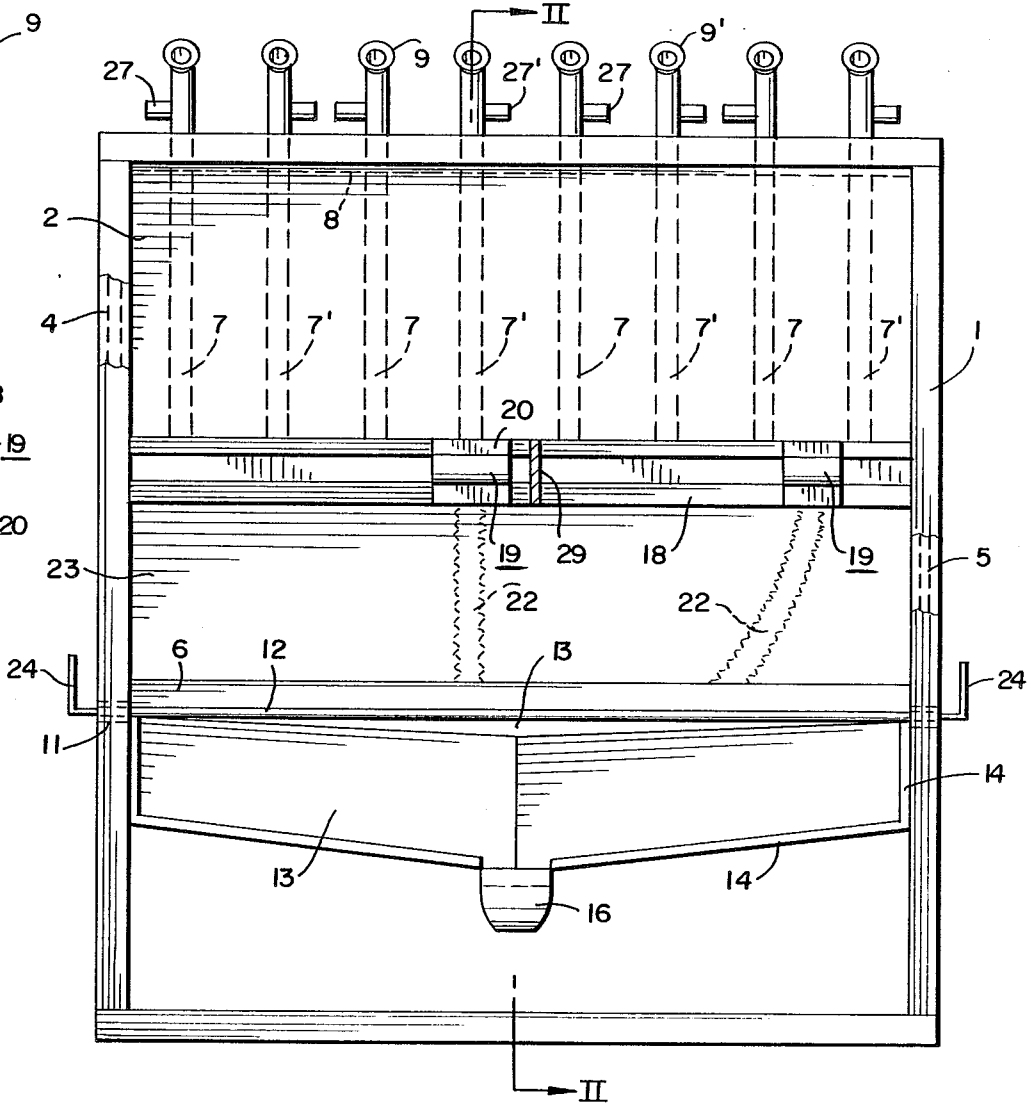
FIG. 1 is a front elevational view of an embodiment of a game device of the present invention.
Figure 2:
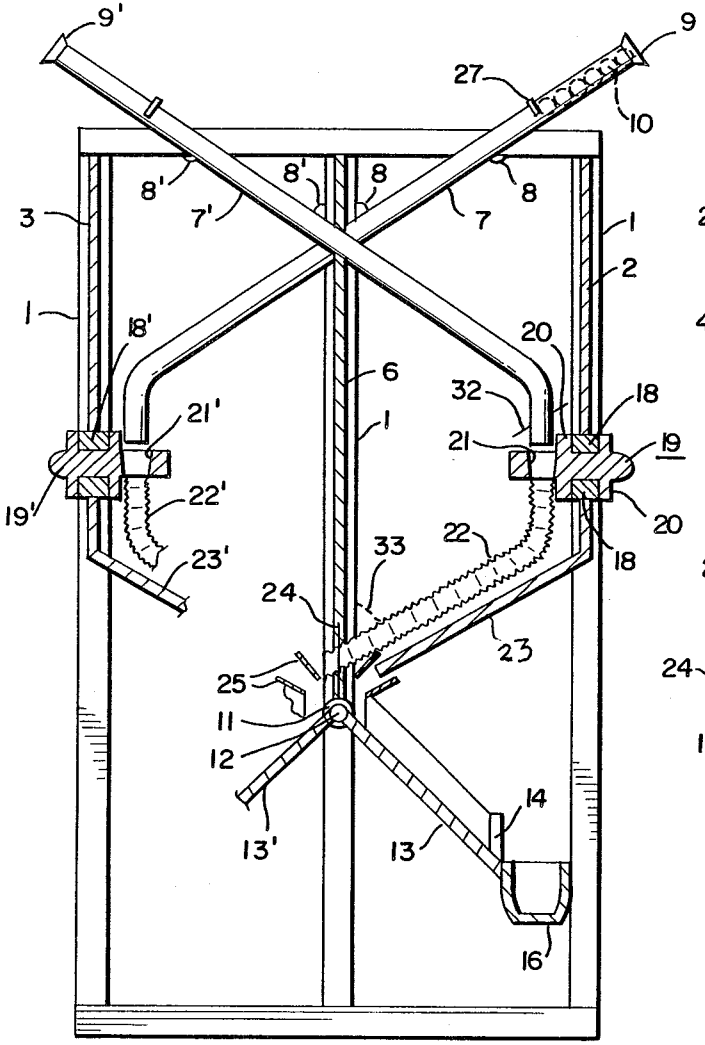
FIG. 2 is a cross-sectional view of the device shown in FIG. 1 taken along line II—II.
Figure 9:
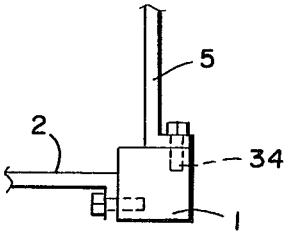
FIG. 9 shows one example of a means for fastening plates to a frame in the present invention.

As shown in FIGS. 1 and 2, the game device comprises mainly a frame 1 having four plates, i.e., a front plate 2, a rear plate 3, a left plate 4, and a right plate 5, affixed thereto with screws 34 (FIG. 9) or other means. A central plate 6 is also fixed to the frame 1, dividing the space surrounded by the four plates 2, 3, 4, and 5 into two subspaces.

A plurality of inclined tubes 7, and 7' are connected by linkages 8, and 8' which in turn are fastened to the frame 1. Each tube 7 or 7' has enlarged opening 9 or 9' on its upper end, whereas its lower end is positioned at opposite side, i.e. subspace near the opponent player. A ball 10 can be put into the opening 9 or 9' of one of the tubes 7 or 7' by a player. The ball 10 can also be thrown into the opening 9 or 9' of one of said tubes 7 or 7'.

Two Bearing seats 11 are positioned on the left and right sides of the frame 1 for rotatably mounting a supporting rod 12. A collecting plate 13 or 13' is fixed to the supporting rod 12. The collecting plate 13 or 13' is inclined so that a ball 10 falling on the plate 13 or 13' can fall toward a basket or a pocket 16 or an oppositely placed unillustrated pocket and is collected therein. The collecting plate 13 or 13' is provided with protection plate 14 or 14' so that the ball 10 can be prevented from falling away from the device.

Figure 4:
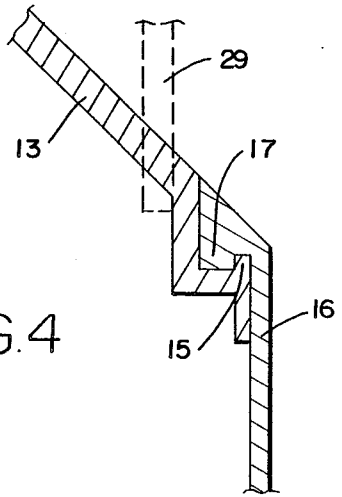
FIG. 4 is an enlarged cross-sectional view showing one embodiment of means for hanging a basket in the present invention.

As shown in FIG. 4, the basket 16 or 16' has a hook portion 17 which can be hung on a hook 15 integrally formed with the lower end of the collecting plate 13 or 13'.

Horizontal guide rails 18 or 18' are provided on the front or rear side of the device, with the ends thereof fixed to the frame 1. Slidable blocks 19 or 19' are slidably mounted on the horizontal guide rails 18 or 18', with flanges 20 or 20' of the blocks 19 or 19' engaged with the rails 18 or 18'. The slidable blocks 19 or 19' have funnel-shaped portion 21 or 21' for guiding a ball 10 so that the ball 10 can smoothly fall through one of the blocks 19 or 19', and a bellow-shaped tube 22 or 22' having its upper end fixed to the block 19 or 19' and its lower end penetrated through the central plate 6 and fixed thereon, to a subspace near the opponent player.

An oblique plate 23 or 23' is fixed to the frame 1 to prevent the bellow-shaped tube 22 or 22' from sagging and to guide the ball 10 to fall via the gap between the lower end of the plate 23 or 23' and the central plate 6, downwardly via the collecting plate 13 or 13' to the basket 16 or 16'.

Figure 3:
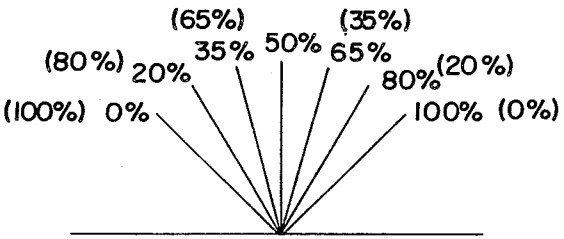
FIG. 3 is an enlarged view showing one embodiment of a scale in the present invention for showing the result of a game.

A pointer 24 is fixed to the end of the supporting rod 12 for indicating the result of the game. FIG. 3 shows an example of a scale 25 which can be printed on the plates 4 and 5. Assuming that each of the players A and B has put 100 balls into the device, i.e. the total amount of the balls in baskets 16 and 16' is 200. If the baskets 16 and 16' have 100 balls therein respectively, the pointer 24 will be aligned with a calibration 50%. In an extreme situation, if all of the 200 balls are in only one of the basket 16 or 16', the pointer 24 will be aligned with a calibration 100%. Therefore the result of the game can be shown quantitatively.

As shown in FIGS. 5–8, each of the tubes 7 or 7' can be provided with a supporting block 28 for pivotably supporting a stopper 27. The tube 7 or 7' has cutaway portion 30 near the supporting block 28. The player can move the stopper 27 to the position shown in FIGS. 7 and 8 so that the balls 10 put into the tube 7 or 7' can be prevented from falling downward further (e.g. the balls shown on the right upper corner of FIG. 2). In this way, the player can deposit some balls on some selected tube(s) and move the stopper 27 to the open position shown in FIGS. 5 and 6 thereafter at a selected time so that the attention of the opponent player can be distracted.

Figure 10:
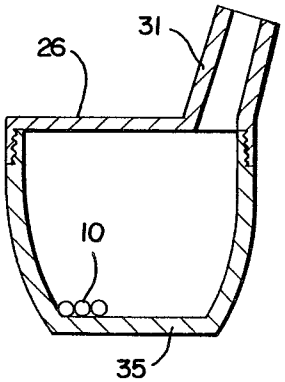
FIG. 10 is a cross-sectional view showing another embodiment of the basket.

FIG. 10 shows another embodiment of a basket (indicated with numeral 35) having threaded upper edge engageable with a lid 26 having a funnel-shaped outlet 31 so that the balls 10 in the basket 35 can be put into the opening 9 or 9' of the tubes 7 or 7' by the player.

A partition 29 and a similar partition (not shown in the drawings) can be provided on the horizontal guide rail 18 or 18' to prevent the slidable block 19 or 19' from being pushed excessively, i.e., the slidable block 19 shown on the right part of FIG. 1 can not be pushed to the left part of FIG. 1 because of the partition 29. As shown in FIG. 1, a slidable block 19' is mounted on the guide rails 18 on each side of partition 29. A basket for containing balls which are going to be put into the device by the player can be hung on the partition 29 with the hook means shown in FIG. 4 (dotted line shows the position of the partition 29 relative to the hook means) so that the player can take the balls conveniently and quickly.

A deflection plate can be provided on the position shown with line 32 (FIG. 2) for preventing a ball 10 from incidentally falling out of the device through the gap between the guide rails 18. Similarly, another deflection plate can be provided on the position shown with line 33 for preventing a ball 10 thrown by the player into the space between the front plate 2 and the central plate 6 from hitting directly the area near the junction of the central plate 6 and the collecting plate 13 and being bounced away from the device.

Figure 11:
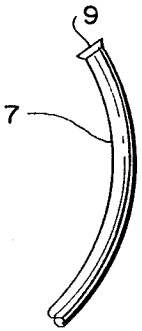
FIG. 11 is an elevational view showing another embodiment of the tube.
Figure 5:
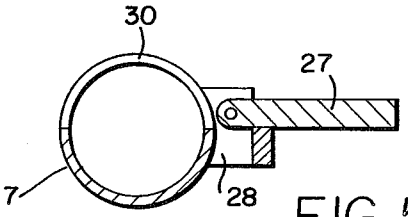
Figure 6:
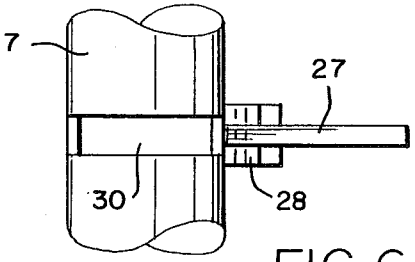
Figure 7:
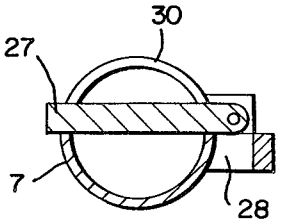
Figure 8:
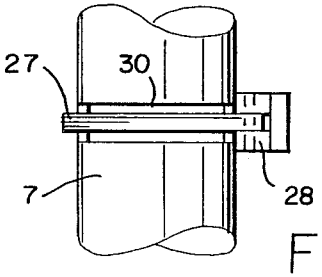

FIG. 11 shows another example of the tube 7 or 7' which is curve-shaped instead of a straight line (shown in FIGS. 1 and 2). The tube 7 or 7' can be of the shape of other curves or the combination of curves and straight lines.

The plates 2, 3, 4, 5, and 6 can be made of transparent and low-noise material and can be replaced by nets. The tubes 7, 7', 22, and 22' can also be made of transparent and low-noise material.

The weight of the device should be able to stabilize itself to withstand the possible movement caused by the player when the player is throwing balls into the device or is moving the slidable block 19 or 19' abruptly and forcefully, otherwise, the lower end of the frame can be extended both forwardly and rearwardly so that the player can stand on the extended portion to help stabilize the device, or a chair can be provided and connected to the frame to stabilize the device.

Some of the parts, e.g., the block 19, the basket 16, of the device shown in the drawings are not drawn to the scale. The balls 10 can be as small as a small marble, rubber ball, plastic ball, or weighted ball. The ball 10 can also be as large as a baseball if the device is large enough. The number of the tubes 7 or 7' on each side can be as high as 20 or even more instead of 4 as shown in the drawings. This device can be used by two players or more, e.g., three players on each side.

Each player can bring one "source" basket having, e.g., 100 balls respectively, on the hand, hang the basket on a hook means (either on partition 29 or other place), or put the basket on the floor. After initiation of the game, each player can put ball(s) into a selected tube, or throw the ball(s) into the tube, or deposit some balls at selected tube(s) by closing the corresponding stopper(s) 27 and thereafter open the stopper at a selected time so that the balls can fall downwardly along the tube. In the meanwhile, each player should also pay attention to the tubes inclined toward her or him for the balls put or thrown into the tubes by the opponent player and try to move the slidable block 19 or 19' to a position under the lower end of the tube having coming balls, so that the balls can fall through the funnel portion 21 or 21', and the tubes 22 or 22' to the basket 16' or 16 near the opponent player. If the player fails to move the slidable block 19 or 19' in time to "intercept" the ball, the ball will fall along the oblique plate 23 or 23', and the collecting plate 13 or 13' and be collected in the basket 16 nearest the player who has failed to intercept the ball. Although by throwing the ball into the tube, the player can lower the chance of the ball to be "caught" by the opponent player, the ball would go through the gap between the tube 7 or 7' and the plate 2 or 3 and eventually fall into the "win" basket of the opponent player if the ball fails to be thrown into the tube 7 or 7'. After both of the players have used up the balls from their "source" basket, the pointer 24 will automatically indicate the result of the game. If player A wins, the pointer will be on the side of the scale 25 near the player B, and vice versa.

If the players want to start another game, they can "balance" the baskets 16 and 16' by taking some balls from the lower basket to the higher basket. Then the baskets 16 and 16' can be removed to dump the balls into the source baskets 35. Then the empty baskets 16 and 16' can be hung on the hook 15 or 15', and the players can start another game again.

I claim:

1. A competitive game device comprising:
- a frame;
- a plurality of balls;
- a plurality of plates fixed to the frame for forming two subspaces;
- a first set of tubes obliquely fastened to the frame with an upper portion of the tubes on the side of a first subspace and a lower portion thereof on the side of a second subspace;
- a second set of tubes obliquely fastened to the frame with an upper portion of the tubes on the side of the second subspace and a lower portion thereof on the side of the first subspace;
- at least one set of horizontal guide rails fastened to both the front side and the rear side of the frame;
- at least two slidable blocks having funnel-shaped portions slidably mounted on each set of the guide rails;
- at least two bellow-shaped tubes having upper ends thereof fastened to the slidable blocks and lower ends thereof penetrating through a central plate between the two subspaces and fixed on the central plate;
- a supporting rod pivotably mounted on the frame;
- at least two oblique collecting plates mounted on the supporting rod;
- at least one basket for collecting balls removably mounted on the lower end of each of the collecting plates;
- at least two source baskets for containing balls to be put into the device;
- a pointer mounted on each of the two ends of the supporting rods; and
- a scale for showing the result of the game.

2. A competitive game device of claim 1, further comprising a supporting block on each of the tubes near the upper ends thereof for supporting a stopper which is selectively used to stop at least a ball.

3. A competitive game device of claim 2, further comprising a partition on the horizontal guide rails; a protection plate fixed to each of the collecting plates; and at least one deflecting plate for preventing balls from falling out of the device.

4. A competitive game device of claim 2, wherein the tubes have enlarged openings on their upper ends; and wherein the tubes are straight tubes, curved tubes, or the combination thereof.

5. A competitive game device of claim 1, further comprising a partition on the horizontal guide rails; a protection plate fixed to each of the collecting plates; and at least one deflecting plate for preventing balls from falling out of the device.

6. A competitive game device of claim 1, wherein the tubes have enlarged openings on their upper ends; and wherein the tubes are straight tubes, curved tubes, or the combination thereof.

* * * * *